US009644906B2

(12) United States Patent
Shimamoto et al.

(10) Patent No.: US 9,644,906 B2
(45) Date of Patent: May 9, 2017

(54) METHOD FOR SELECTING HEAT MEDIUM OF USE SIDE HEAT EXCHANGER IN INSTALLING AIR-CONDITIONING SYSTEM

(75) Inventors: Daisuke Shimamoto, Tokyo (JP); Osamu Morimoto, Tokyo (JP); Takayoshi Honda, Tokyo (JP); Koji Azuma, Tokyo (JP); Koji Nishioka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 475 days.

(21) Appl. No.: 14/360,712

(22) PCT Filed: Nov. 30, 2011

(86) PCT No.: PCT/JP2011/006703
§ 371 (c)(1),
(2), (4) Date: May 27, 2014

(87) PCT Pub. No.: WO2013/080257
PCT Pub. Date: Jun. 6, 2013

(65) Prior Publication Data

US 2014/0318734 A1 Oct. 30, 2014

(51) Int. Cl.
*F28F 27/02* (2006.01)
*F25D 17/02* (2006.01)
(Continued)

(52) U.S. Cl.
CPC ..... *F28F 27/02* (2013.01); *F24F 3/065* (2013.01); *F24F 11/006* (2013.01); *F25B 13/00* (2013.01);
(Continued)

(58) Field of Classification Search
CPC ..... F25B 2500/22–2500/222; F25B 2500/19; F25B 2500/24; F25B 2600/05; F25B 2700/04; F24F 3/065
(Continued)

(56) References Cited

U.S. PATENT DOCUMENTS 6,119,478 A 9/2000 Sada et al.
7,454,956 B1 * 11/2008 LoPresti ..... G01M 3/3227 165/11.1
(Continued)

FOREIGN PATENT DOCUMENTS

JP 08-094150 A 4/1996
JP 2002-267287 A 9/2002
(Continued)

OTHER PUBLICATIONS

International Search Report of the International Searching Authority mailed Mar. 6, 2012 for the corresponding international application No. PCT/JP2011/006703 (and English translation).
(Continued)

*Primary Examiner* — Ryan J Walters
*Assistant Examiner* — For K Ling
(74) *Attorney, Agent, or Firm* — Posz Law Group, PLC

(57) ABSTRACT

A method for selecting a heat medium in installing an air-conditioning system includes: determining power required for use side heat exchangers corresponding to a plurality of air-conditioned spaces; calculating a total refrigerant amount required when a refrigerant is circulated through all the use side heat exchangers having the determined power; calculating a refrigerant concentration when the total refrigerant amount leaks to each air-conditioned space using the refrigerant, for each air-conditioned space; determining the refrigerant concentration for each air-conditioned space exceeds a predetermined limit concentration;
(Continued)

when any air-conditioned space exceeds the limit concentration, selecting, as a nontoxic medium, the circulation heat medium of the use side heat exchanger installed in one of the air-conditioned spaces; and calculating a total refrigerant amount required when the refrigerant is circulated through all other use side heat exchangers.

7 Claims, 10 Drawing Sheets

(51) Int. Cl.

| | |
|---|---|
| ***F25B 45/00*** | (2006.01) |
| ***F25B 13/00*** | (2006.01) |
| ***F25B 25/00*** | (2006.01) |
| ***F25B 49/00*** | (2006.01) |
| ***F24F 3/06*** | (2006.01) |
| ***F24F 11/00*** | (2006.01) |

(52) U.S. Cl.
CPC ..... *F25B 25/005* (2013.01); *F25B 45/00* (2013.01); *F25B 49/005* (2013.01); *F25D 17/02* (2013.01); *F25B 2313/003* (2013.01); *F25B 2313/0231* (2013.01); *F25B 2339/047* (2013.01); *F25B 2500/19* (2013.01)

(58) Field of Classification Search
USPC ..... 62/126, 127, 129, 185, 199, 200, 201
See application file for complete search history.

(56) References Cited

U.S. PATENT DOCUMENTS

| | | | | |
|---|---|---|---|---|
| 7,954,333 | B2 * | 6/2011 | Yoshimi | F24F 3/065 62/127 |
| 2010/0154447 | A1 * | 6/2010 | Yoshimi | F25B 49/005 62/149 |
| 2012/0055177 | A1 * | 3/2012 | Kim | F24D 11/0214 62/79 |
| 2014/0223931 | A1 * | 8/2014 | Shapiro | F25B 49/005 62/89 |

FOREIGN PATENT DOCUMENTS

| | | | |
|---|---|---|---|
| JP | 2003-130482 | A | 5/2003 |
| JP | 2006-029744 | A | 2/2006 |
| JP | 2007-046822 | A | 2/2007 |
| WO | 98/29699 | A1 | 7/1998 |
| WO | 2009/133643 | A1 | 11/2009 |
| WO | 2011/064830 | A1 | 6/2011 |

OTHER PUBLICATIONS

Extended European Search Report issued Jul. 6, 2015 in the corresponding European patent application No. 11876522.1.
Office Action mailed Feb. 16, 2017 in the corresponding European patent application No. 11876522.1.

* cited by examiner

METHOD FOR SELECTING HEAT MEDIUM OF USE SIDE HEAT EXCHANGER IN INSTALLING AIR-CONDITIONING SYSTEM

CROSS REFERENCE TO RELATED APPLICATION

This application is a U.S. national stage application of PCT/JP2011/006703 filed on Nov. 30, 2011, the contents of which are incorporated herein by reference.

TECHNICAL FIELD

The present invention relates to an air-conditioning apparatus used in, for example, a multi-air-conditioning apparatus for building.

BACKGROUND

As an air-conditioning apparatus, there is an apparatus in which a heat source unit (outdoor unit) is disposed outside a building and an indoor unit is disposed inside the building, for example, as in a multi-air-conditioning apparatus for building. A refrigerant circulating through a refrigerant circuit of such an air-conditioning apparatus rejects heat to (or removes heat from) air supplied to a heat exchanger of the indoor unit, thereby heating or cooling the air. Then, the heated or cooled air is sent to an air-conditioned space, thereby performing heating or cooling.

A building generally includes a plurality of indoor spaces, and thus such an air-conditioning apparatus also includes a plurality of indoor units accordingly. In addition, in the case where the size of the building is large, a refrigerant pipe connecting the outdoor unit to the indoor unit may be 100 m. When the length of the pipe connecting the outdoor unit to the indoor unit is long, an amount of the refrigerant injected to the refrigerant circuit is increased due to the long pipe.

Each indoor unit of such a multi-air-conditioning apparatus for building is generally disposed and used in an indoor space where a person is present (e.g., an office space, a living room, a store, etc.). When the refrigerant leaks from an indoor unit disposed in an indoor space for a certain reason, there is a possibility that the leak becomes problematic in terms of effect on human body and safety, since the refrigerant is flammable or toxic depending on its type. In addition, even when the refrigerant is not harmful to human body, it is also assumed that the oxygen concentration in the indoor space decreases due to the refrigerant leak, which influences on human body.

In order to deal with such a problem, a method is conceivable in which a two-loop system is employed in an air-conditioning apparatus, a refrigerant is used in a primary loop, harmless water or brine is used in a secondary loop to perform air-conditioning on a space where a person is present, the refrigerant in the primary side is used to perform direct air-conditioning on a shared space such as a corridor (e.g., see Patent Literature 1).

However, in the above system in which both air-conditioning with the refrigerant and air-conditioning with water or brine are performed, it is impossible to clearly determine which spaces air-conditioning with the refrigerant and air-conditioning with water or brine are selectively used.

PATENT LITERATURE

Patent Literature 1: WO2011-064830A1

In the art as in Patent Literature 1 described above, there is hither to no method for selectively using air-conditioning with the refrigerant and air-conditioning with water or brine.

SUMMARY

Therefore, the present invention is directed to a usage method of presenting in which space air-conditioning with a refrigerant and air-conditioning with water or brine are selectively used in installing a system in which the air-conditioning with the refrigerant and the air-conditioning with water or brine are performed.

A method for selecting a heat medium of each of a plurality of use side heat exchangers in installing an air-conditioning system according to the present invention is a method for selecting a heat medium of each use side heat exchanger in installing an air-conditioning system in which a plurality of spaces are air-conditioning spaces and two types of circulation heat media including a refrigerant and a nontoxic medium are allowed to coexist as the circulation heat media of a use side heat exchanger installed in each of the plurality of spaces, the method including:

a first step of determining power required for the use side heat exchanger corresponding to each air-conditioned space;

a second step of calculating a total refrigerant amount required when the refrigerant is circulated through all the use side heat exchangers having the determined power;

a third step of calculating a refrigerant concentration when the total refrigerant amount leaks to each air-conditioned space using the refrigerant, for each air-conditioned space;

a fourth step of determining whether or not the refrigerant concentration for each air-conditioned space exceeds a predetermined limit concentration;

a fifth step of, when there are any air-conditioned spaces exceeding the limit concentration in the fourth step, selecting a nontoxic medium as the circulation heat medium of a use side heat exchanger installed in one of the air-conditioned spaces; and a sixth step of calculating a total refrigerant amount required when the refrigerant is circulated through all the use side heat exchangers other than the use side heat exchanger in which the nontoxic medium is selected, as the total refrigerant amount in the third step.

In a system which is able to selectively use both a refrigerant and water or brine in an indoor unit as a material transmitting heat to a living space, it is possible to automatically and simply select a method for selectively using them.

DETAILED DESCRIPTION

Embodiment 1

Figure 1:
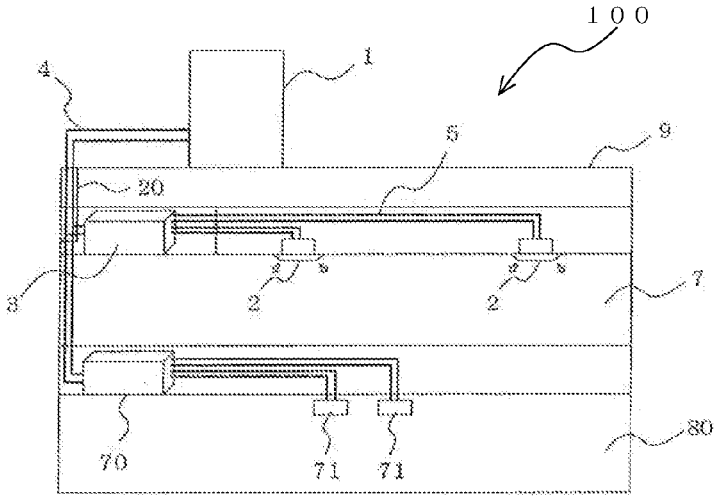
FIG. 1 is a schematic diagram showing an installation example of an air-conditioning apparatus according to an embodiment of the present invention.

As shown in FIG. 1, an air-conditioning apparatus 100 according to the embodiment includes one outdoor unit 1 which is a heat source unit, a plurality of indoor units 2, a heat medium relay unit 3 interposed between the outdoor unit 1 and the indoor units 2, a plurality of indoor units 71, and a relay unit 70 interposed between the outdoor unit 1 and the indoor units 71. The heat medium relay unit 3 exchanges heat between a heat source side refrigerant and a heat medium. The outdoor unit 1 and the heat medium relay unit 3 are connected to each other via refrigerant pipes 4 for circulating the heat source side refrigerant. The heat medium relay unit 3 and each indoor unit 2 are connected to each other via pipes (heat medium pipes) 5 for circulating the heat medium. Cooling energy or heating energy generated by the outdoor unit 1 is sent via the heat medium relay unit 3 to each indoor unit 2. In addition, the refrigerant having passed through the relay unit 70 is sent directly to each indoor unit 71.

The air-conditioning apparatus 100 according to the embodiment employs a method enabling both a method of indirectly using the heat source side refrigerant (an indirect method) and a method of directly using the heat source side refrigerant (a direct method). In other words, the air-conditioning apparatus 100 performs both: an operation in which cooling energy or heating energy stored in the heat source side refrigerant is transmitted to media different from the heat source side refrigerant (hereinafter, referred to as heat medium), and an air-conditioned space is cooled or heated with the cooling energy or heating energy stored in the heat medium; and an operation in which the air-conditioned space is cooled or heated directly with the cooling energy or heating energy stored in the heat source side refrigerant.

Figure 2:
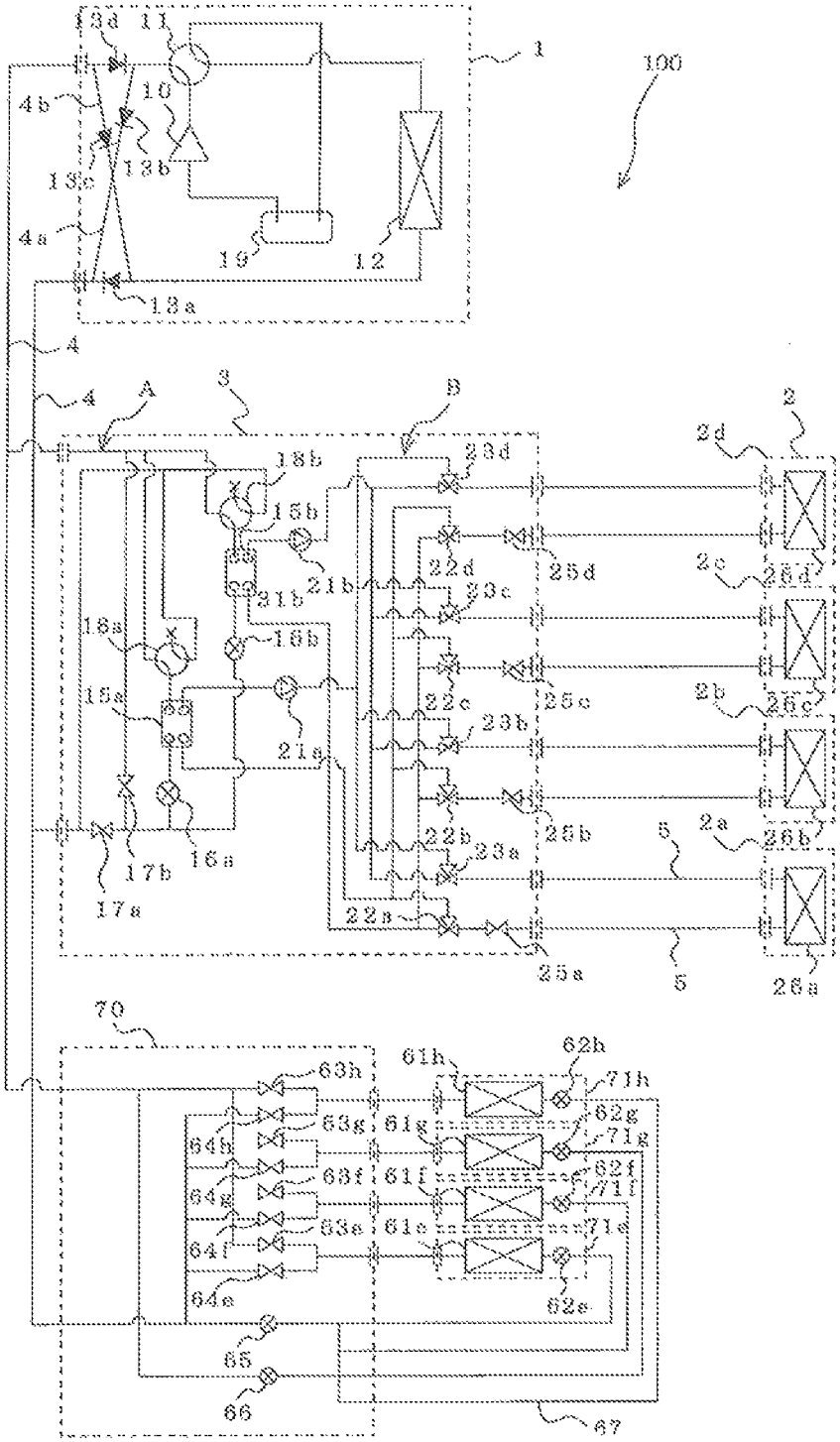
FIG. 2 is a refrigerant circuit configuration example of the air-conditioning apparatus according to the embodiment of the present invention.

As shown in FIG. 2, the air-conditioning apparatus 100 has a refrigeration cycle through which a refrigerant circulates, and each of indoor units 2*a* to 2*d* and 71*e* to 71*f* is allowed to freely select a cooling mode or a heating mode as an operation mode.

The air-conditioning apparatus 100 according to the embodiment has a refrigerant circulation circuit A in which a single refrigerant such as R-22 or R-134a, a pseudo azeotropic refrigerant mixture such as R-410A or R-404A, a zeotropic refrigerant mixture such as R-407C, a refrigerant which contains a double bond within a chemical formula thereof and of which global warning potential is relatively low, such as $CF_3CF{=}CH_2$, a mixture thereof, or a natural refrigerant such as $CO_2$ or propane is used as a refrigerant; and a heat medium circulation circuit B in which water or the like is used as a heat medium.

[Outdoor Unit 1]

The outdoor unit 1 is provided with a compressor 10 which compresses the refrigerant, a first refrigerant flow switching device 11 composed of a four-way valve or the like, a heat source side heat exchanger 12 which serves as an evaporator or a condenser, and an accumulator 19 which stores an excess refrigerant, and these components are connected with the refrigerant pipe 4.

In addition, the outdoor unit 1 is provided with a first connection pipe 4*a*, a second connection pipe 4*b*, and check valves 13 (13*a* to 13*d*). Since the first connection pipe 4*a*, the second connection pipe 4*b*, the check valve 13*a*, the check valve 13*b*, the check valve 13*c*, and the check valve 13*d* are provided, the flow of the heat source side refrigerant which flows into the heat medium relay unit 3 and the relay unit 70 can be a constant direction regardless of an operation requested by the indoor unit 2.

The compressor 10 sucks the heat source side refrigerant and compresses the heat source side refrigerant into a high-temperature and high-pressure state, and may be composed of, for example, a capacity-controllable inverter compressor or the like.

The first refrigerant flow switching device 11 switches between the flow of the heat source side refrigerant during a heating operation mode (during a heating only operation mode and during a heating main operation mode) and the flow of the heat source side refrigerant during a cooling operation mode (during a cooling only operation mode and during a cooling main operation mode).

The heat source side heat exchanger 12 serves as an evaporator during the heating operation, serves as a condenser during the cooling operation, and exchanges heat between the heat source side refrigerant and air supplied from an air-sending device such as a fan which is not shown.

[Indoor Unit 2]

Each indoor unit 2 is provided with a use side heat exchanger 26. The use side heat exchanger 26 is connected to a heat medium flow control device 25 and a second heat medium flow switching device 23 of the heat medium relay unit 3 via pipes 5. The use side heat exchanger 26 exchanges heat between the heat medium and air supplied from an air-sending device such as a fan which is not shown, to generate air for heating or air for cooling which is to be supplied to an indoor space 7.

[Indoor Unit 71]

Each indoor unit 71 is provided with a use side heat exchanger 61 and an expansion valve 62. The use side heat exchanger 61 is connected to an expansion device 65 and an expansion device 66 of the relay unit 70 via pipes 67 and to solenoid valves 63 and solenoid valves 64 of the relay unit 70 via pipes. The use side heat exchanger 61 exchanges heat between the heat medium and air supplied from an air-sending device such as a fan which is not shown, to generate air for heating or air for cooling which is to be supplied to an indoor space 80.

[Heat Medium Relay Unit 3]

The heat medium relay unit 3 is provided with two intermediate heat exchangers 15 (15*a* and 15*b*) which exchange heat between the refrigerant and the heat medium, two expansion devices 16 (16*a* and 16*b*) which reduce the pressure of the refrigerant, two opening/closing devices 17 (17*a* and 17*b*) which open/close a flow path of the refrigerant pipe 4, two second refrigerant flow switching devices 18 (18*a* and 18*b*) which switch a refrigerant flow path, two pumps 21 (21*a* and 21*b*) which circulates the heat medium, four first heat medium flow switching devices 22 (22*a* to 22*d*) which are connected to one of the pipes 5, the four second heat medium flow switching devices 23 (23*a* to 23*d*) which are connected to the other pipe 5, and the four heat medium flow control devices 25 (25*a* to 25*b*) which are connected to the pipe 5 to which the first heat medium flow switching devices 22 are connected.

The intermediate heat exchangers 15*a* and 15*b* serve as condensers (radiators) or evaporators, exchange heat between the heat source side refrigerant and the heat medium, and transmit to the heat medium cooling energy or heating energy which is generated by the outdoor unit 1 and stored in the heat source side refrigerant. The intermediate heat exchanger 15*a* is provided between the expansion device 16*a* and the second refrigerant flow switching device 18*a* in the refrigerant circulation circuit A and is used to cool the heat medium during a cooling and heating mixed operation mode. The intermediate heat exchanger 15*b* is provided between the expansion device 16*b* and the second refrigerant flow switching device 18*b* in the refrigerant circulation circuit A and is used to heat the heat medium during the cooling and heating mixed operation mode.

The expansion devices 16*a* and 16*b* have functions as a pressure reducing valve and an expansion valve and reduce the pressure of the heat source side refrigerant to expand the heat source side refrigerant. The expansion device 16*a* is provided at the upstream side of the intermediate heat exchanger 15*a* in the flow of the heat source side refrigerant during the cooling only operation mode. The expansion device 16*b* is provided at the upstream side of the intermediate heat exchanger 15*b* in the flow of the heat source side refrigerant during the cooling only operation mode. These expansion devices 16 may be composed of expansion devices whose opening degree is variably controllable, such as electronic expansion valves.

The opening/closing devices 17*a* and 17*b* are composed of two-way valves or the like and open/close the refrigerant pipe 4.

The second refrigerant flow switching devices 18*a* and 18*b* are composed of four-way valves or the like and switch flow of the heat source side refrigerant in accordance with the operation mode. The second refrigerant flow switching device 18*a* is provided at the downstream side of the intermediate heat exchanger 15*a* in the flow of the heat source side refrigerant during the cooling only operation mode. The second refrigerant flow switching device 18*b* is provided at the downstream side of the intermediate heat exchanger 15*b* in the flow of the heat source side refrigerant during the cooling only operation mode.

The pumps 21*a* and 21*b* circulate the heat medium within the pipes 5. The pump 21*a* is provided on the pipe 5 between the intermediate heat exchanger 15*a* and the second heat medium flow switching device 23. The pump 21*b* is provided on the pipe 5 between the intermediate heat exchanger 15*b* and the second heat medium flow switching device 23. These pumps 21 may be composed of, for example, capacity-controllable pumps or the like. It should be noted that the pump 21*a* may be provided on the pipe 5 between the intermediate heat exchanger 15*a* and the first heat medium flow switching devices 22. In addition, the pump 21*b* may be provided on the pipe 5 between the intermediate heat exchanger 15*b* and the first heat medium flow switching devices 22.

The first heat medium flow switching devices 22 (22*a* to 22*d*) are composed of three-way valves or the like and switch a flow path of the heat medium. The number of the provided first heat medium flow switching devices 22 corresponds to the number of the installed indoor units 2. Each first heat medium flow switching device 22 is connected at one of the three ways to the intermediate heat exchanger 15*a*, at one of the three ways to the intermediate heat exchanger 15*b*, and at one of the three ways to the heat medium flow control device 25, and is provided at an outlet side of the heat medium flow path at the use side heat exchanger 26. It should be noted that the first heat medium flow switching devices 22 are illustrated as the first heat medium flow switching device 22*a*, the first heat medium flow switching device 22*b*, the first heat medium flow switching device 22*c*, and the first heat medium flow switching device 22*d* in order from the lower side of the sheet surface so as to correspond to the indoor units 2.

The second heat medium flow switching devices 23 (23*a* to 23*d*) are composed of three-way valves or the like and switch the flow path of the heat medium. The number (four here) of the provided second heat medium flow switching devices 23 corresponds to the number of the installed indoor units 2. Each second heat medium flow switching device 23 is connected at one of the three ways to the intermediate heat exchanger 15*a*, at one of the three ways to the intermediate heat exchanger 15*b*, and at one of the three ways to the use side heat exchanger 26, and is provided at an inlet side of the heat medium flow path at the use side heat exchanger 26. Here, the second heat medium flow switching devices 23 are illustrated as the second heat medium flow switching device 23*a*, the second heat medium flow switching device 23*b*, the second heat medium flow switching device 23*c*, and the second heat medium flow switching device 23*d* in order from the lower side of the sheet surface so as to correspond to the indoor units 2.

The heat medium flow control devices 25 (25*a* to 25*d*) are composed of two-way valves whose opening area is controllable, or the like, and adjust a flow rate of the heat medium flowing through the pipe 5. The number of the provided heat medium flow control devices 25 corresponds to the number of the installed indoor units 2. Each heat medium flow control device 25 is connected at one way to the use side heat exchanger 26 and at the other way to the first heat medium flow switching device 22, and is provided at the outlet side of the heat medium flow path at the use side heat exchanger 26. Here, the heat medium flow control devices 25 are illustrated as the heat medium flow control device 25*a*, the heat medium flow control device 25*b*, the heat medium flow control device 25*c*, and the heat medium flow control device 25*d* in order from the lower side of the sheet surface so as to correspond to the indoor units 2. In addition, each heat medium flow control device 25 may be provided at the inlet side of the heat medium flow path at the use side heat exchanger 26.

The pipes 5 for circulating the heat medium therethrough are composed of a pipe connected to the intermediate heat exchanger 15*a* and a pipe connected to the intermediate heat exchanger 15*b* and are connected via the first heat medium flow switching devices 22 and the second heat medium flow switching devices 23. The pipes 5 are branched in accordance with the number of the indoor units 2 connected to the heat medium relay unit 3 (here, each branched into 4 portions). The pipes 5 are configured such that it is determined whether to cause the heat medium from the intermediate heat exchanger 15*a* to flow into the use side heat exchanger 26 or the heat medium from the intermediate heat exchanger 15*b* to flow into the use side heat exchanger 26, by controlling the first heat medium flow switching devices 22 and the second heat medium flow switching devices 23.

[Relay Unit 70]

The relay unit 70 is arranged between the outdoor unit 1 and the indoor units 71 (71*e* to 71*h*). The relay unit 70 includes the solenoid valves 63*e* to 63*h* which switch the flow of the refrigerant to the cooling side, the solenoid valves 64*e* to 64*h* which switch the flow of the refrigerant to the heating side, a cooling indoor unit inlet expansion device 65, and an expansion device 66 which opens during the heating only/heating main operation, and allows for cooling and heating mixed operation of the indoor units 71. In addition, the indoor units 71 (71*e* to 71*h*) each include a use side heat exchanger 61 (61*e* to 61*h*) using the refrigerant and an indoor expansion device 62 (62*e* to 62*h*).

[Explanation of Operation Mode]

In the air-conditioning apparatus 100, the compressor 10, the first refrigerant flow switching device 11, the heat source side heat exchanger 12, the opening/closing devices 17, the second refrigerant flow switching devices 18, the refrigerant flow paths at the intermediate heat exchangers 15, the expansion devices 16, and the accumulator 19 are connected to each other via the refrigerant pipes 4 to form the refrigerant circulation circuit A. In addition, the heat medium flow paths at the intermediate heat exchangers 15, the pumps 21, the first heat medium flow switching devices 22, the heat medium flow control devices 25, the use side heat exchangers 26, and the second heat medium flow switching devices 23 are connected to each other via the pipes 5 to form the heat medium circulation circuit B. In other words, a plurality of the use side heat exchangers 26 are connected in parallel to each of the intermediate heat exchangers 15.

Thus, in the air-conditioning apparatus 100, the outdoor unit 1 and the heat medium relay unit 3 are connected to each other via the intermediate heat exchanger 15*a* and the intermediate heat exchanger 15*b* provided in the heat medium relay unit 3, and the heat medium relay unit 3 and the indoor units 2 are also connected to each other via the intermediate heat exchanger 15*a* and the intermediate heat exchanger 15*b*. In other words, in the air-conditioning apparatus 100, at the intermediate heat exchanger 15*a* and the intermediate heat exchanger 15*b*, heat is exchanged between the heat source side refrigerant circulating through the refrigerant circulation circuit A and the heat medium circulating through the heat medium circulation circuit B.

It should be noted that separately from the above refrigerant circuits, the outdoor unit 1 and the relay unit 70 are connected to each other via the pipes 4, and the refrigerant is supplied from the relay unit 70 also to the indoor units 71.

Each operation mode executed by the air-conditioning apparatus 100 will be described. On the basis of an instruction from each indoor unit 2, the air-conditioning apparatus 100 allows a cooling operation or heating operation to be performed by the indoor unit 2. In other words, the air-conditioning apparatus 100 allows the same operation to be performed by all of the indoor units 2 and the indoor units 71, and allows different operations to be performed by the respective indoor units 2.

The operation modes executed by the air-conditioning apparatus 100 include the cooling only operation mode in which all the activated indoor units 2 and 71 perform a cooling operation, the heating only operation mode in which all the activated indoor units 2 and 71 perform a heating operation, the cooling main operation mode as the cooling and heating mixed operation mode in which a cooling load is greater, and the heating main operation mode as the cooling and heating mixed operation mode in which a heating load is greater. Hereinafter, each operation mode will be described with flows of the heat source side refrigerant and the heat medium.

[Cooling Only Operation Mode]

Figure 3:
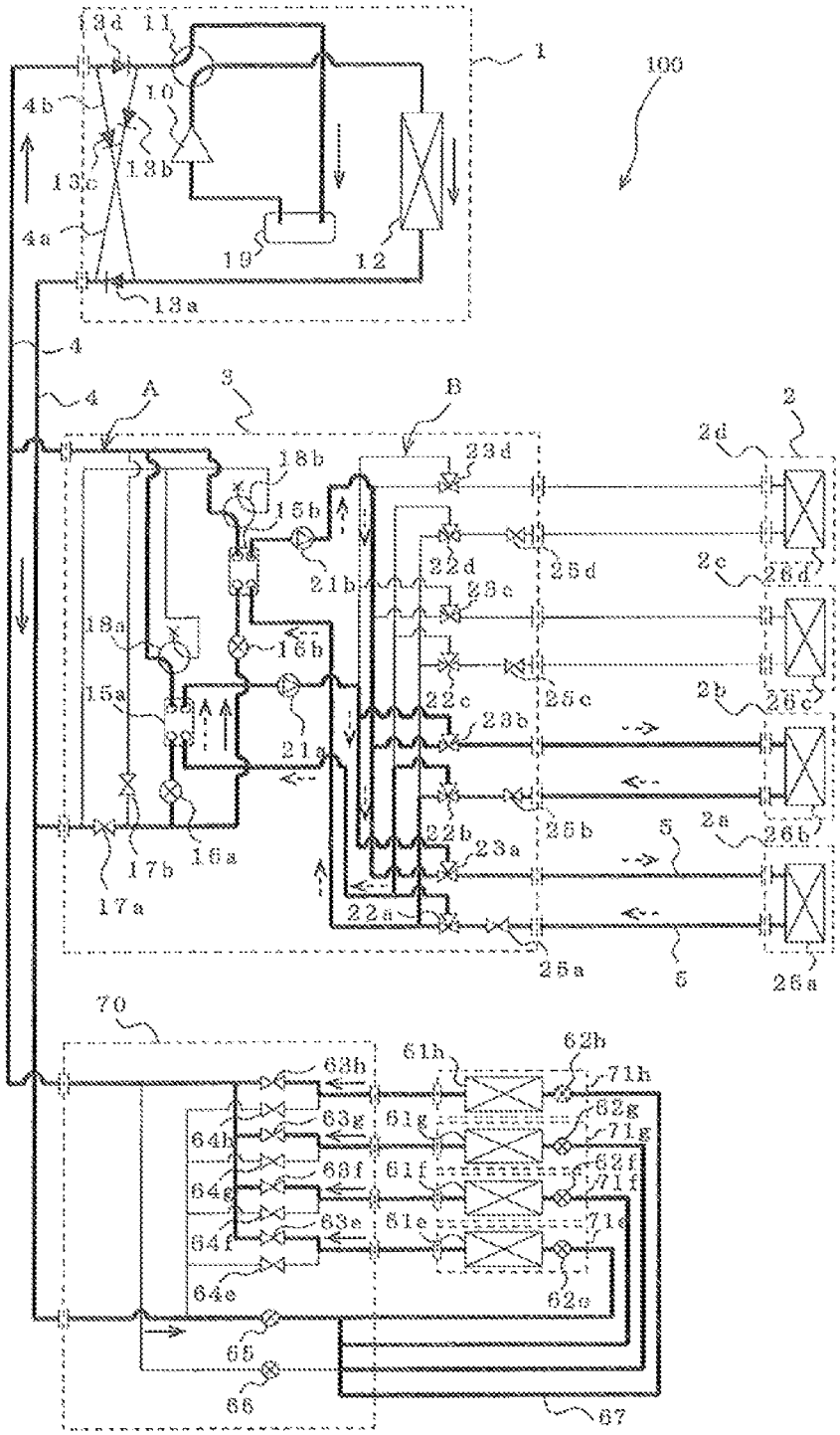
FIG. 3 is a refrigerant circuit diagram showing a flow of refrigerant during a cooling only operation mode of the air-conditioning apparatus shown in FIG. 2.

FIG. 3 is a refrigerant circuit diagram showing the flow of the refrigerant during the cooling only operation mode of the air-conditioning apparatus 100 shown in FIG. 2. In FIG. 3, the cooling only operation mode will be described with, an example, the case where cooling energy loads are generated at the use side heat exchangers 26*a*, 26*b*, and 61*e* to 61*h*. In FIG. 3, the pipes represented by thick lines indicate pipes through which the refrigerants (the heat source side refrigerant and the heat medium) flow. In addition, in FIG. 3, the flow direction of the heat source side refrigerant is indicated by solid arrows, and the flow direction of the heat medium is indicated by dashed arrows.

In the case of the cooling only operation mode shown in FIG. 3, in the outdoor unit 1, the first refrigerant flow switching device 11 is switched such that the heat source side refrigerant having discharged from the compressor 10 flows into the heat source side heat exchanger 12. In the heat medium relay unit 3, the pump 21*a* and the pump 21*b* are actuated, the heat medium flow control device 25*a* and the heat medium flow control device 25*b* are opened, and the heat medium flow control device 25*c* and the heat medium flow control device 25*d* are fully closed, whereby the heat medium circulates between each of the intermediate heat exchanger 15*a* and the intermediate heat exchanger 15*b* and the use side heat exchanger 26*a* and the use side heat exchanger 26*b*.

First, flow of the heat source side refrigerant in the refrigerant circulation circuit A will be described. The low-temperature and low-pressure refrigerant is compressed by the compressor 10 into a high-temperature and high-pressure gas refrigerant, and is discharged therefrom. The high-temperature and high-pressure gas refrigerant having discharged from the compressor 10 flows through the first refrigerant flow switching device 11 into the heat source side heat exchanger 12. Then, the gas refrigerant becomes a high-pressure liquid refrigerant while rejecting heat to the outside air at the heat source side heat exchanger 12. The high-pressure refrigerant having flowed out of the heat source side heat exchanger 12 flows out of the outdoor unit 1 through the check valve 13*a*, and flows through the refrigerant pipe 4 into the heat medium relay unit 3. The high-pressure refrigerant having flowed into the heat medium relay unit 3 flows through the opening/closing device 17*a*, then is branched, is expanded at the expansion device 16*a* and the expansion device 16*b* into a low-temperature and low-pressure two-phase refrigerant. It should be noted that the opening/closing device 17*b* is closed.

The two-phase refrigerant flows into the intermediate heat exchanger 15*a* and the intermediate heat exchanger 15*b* which act as evaporators, and removes heat from the heat medium circulating through the heat medium circulation circuit B, whereby the two-phase refrigerant becomes a low-temperature and low-pressure gas refrigerant while cooling the heat medium. The gas refrigerant having flowed out of the intermediate heat exchanger 15*a* and the intermediate heat exchanger 15*b* flows out of the heat medium relay unit 3 through the second refrigerant flow switching device 18*a* and the second refrigerant flow switching device 18*b* and flows through the refrigerant pipe 4 into the outdoor unit 1 again. The refrigerant having flowed into the outdoor unit 1 flows through the check valve 13*d* and is sucked into the compressor 10 again through the first refrigerant flow switching device 11 and the accumulator 19.

Next, flow of the heat medium in the heat medium circulation circuit B will be described. In the cooling only operation mode, cooling energy of the heat source side refrigerant is transmitted to the heat medium at both the intermediate heat exchanger 15*a* and the intermediate heat exchanger 15*b*, and the cooled heat medium is moved in the pipes 5 by the pump 21*a* and the pump 21*b*. The heat medium having compressed by the pump 21*a* and the pump 21*b* and flowed out therefrom flows through the second heat medium flow switching device 23*a* and the second heat medium flow switching device 23*b* into the use side heat exchanger 26*a* and the use side heat exchanger 26*b*. Then, the heat medium removes heat from the indoor air at the use side heat exchanger 26*a* and the use side heat exchanger 26*b*, thereby cooling the indoor space 7.

Then, the heat medium flows out of the use side heat exchanger 26*a* and the use side heat exchanger 26*b* and flows into the heat medium flow control device 25*a* and the heat medium flow control device 25*b*. At that time, the flow rate of the heat medium is controlled by the action of the heat medium flow control device 25*a* and the heat medium flow control device 25*b* to a flow rate required for an air conditioning load required in the indoor, and the heat medium flows into the use side heat exchanger 26*a* and the use side heat exchanger 26*b*. The heat medium having flowed out of the heat medium flow control device 25*a* and the heat medium flow control device 25*b* flows through the first heat medium flow switching device 22*a* and the first heat medium flow switching device 22*b* into the intermediate heat exchanger 15*a* and the intermediate heat exchanger 15*b* and is sucked into the pump 21*a* and the pump 21*b* again.

In executing the cooling only operation mode, since there is no need to flow the heat medium to the use side heat exchanger 26 in which there is no thermal load (including thermo-off), the flow path is closed by the heat medium flow control device 25 such that the heat medium does not flow to the use side heat exchanger 26. In FIG. 3, the heat medium is flowing through the use side heat exchanger 26*a* and the use side heat exchanger 26*b* since there are thermal loads in the use side heat exchanger 26*a* and the use side heat exchanger 26*b*, but there are no thermal loads in the use side heat exchanger 26*c* and the use side heat exchanger 26*d*, and the corresponding heat medium flow control device 25*c* and the corresponding heat medium flow control device 25*d* are fully closed. Then, when thermal loads are generated from the use side heat exchanger 26*c* and the use side heat exchanger 26*d*, the heat medium flow control device 25*c* and the heat medium flow control device 25*d* may be opened to circulate the heat medium therethrough.

In addition, the heat source side refrigerant having passed through the above pipe 4 also flows to the relay unit 70 side, passes through the expansion device 65 and the expansion devices 62, then removes heat and evaporates at the use side heat exchangers 61, passes through the solenoid valve 63, and then returns to the outdoor unit 1. Thus, the indoor space 80 is cooled.

[Heating Only Operation Mode]

Figure 4:
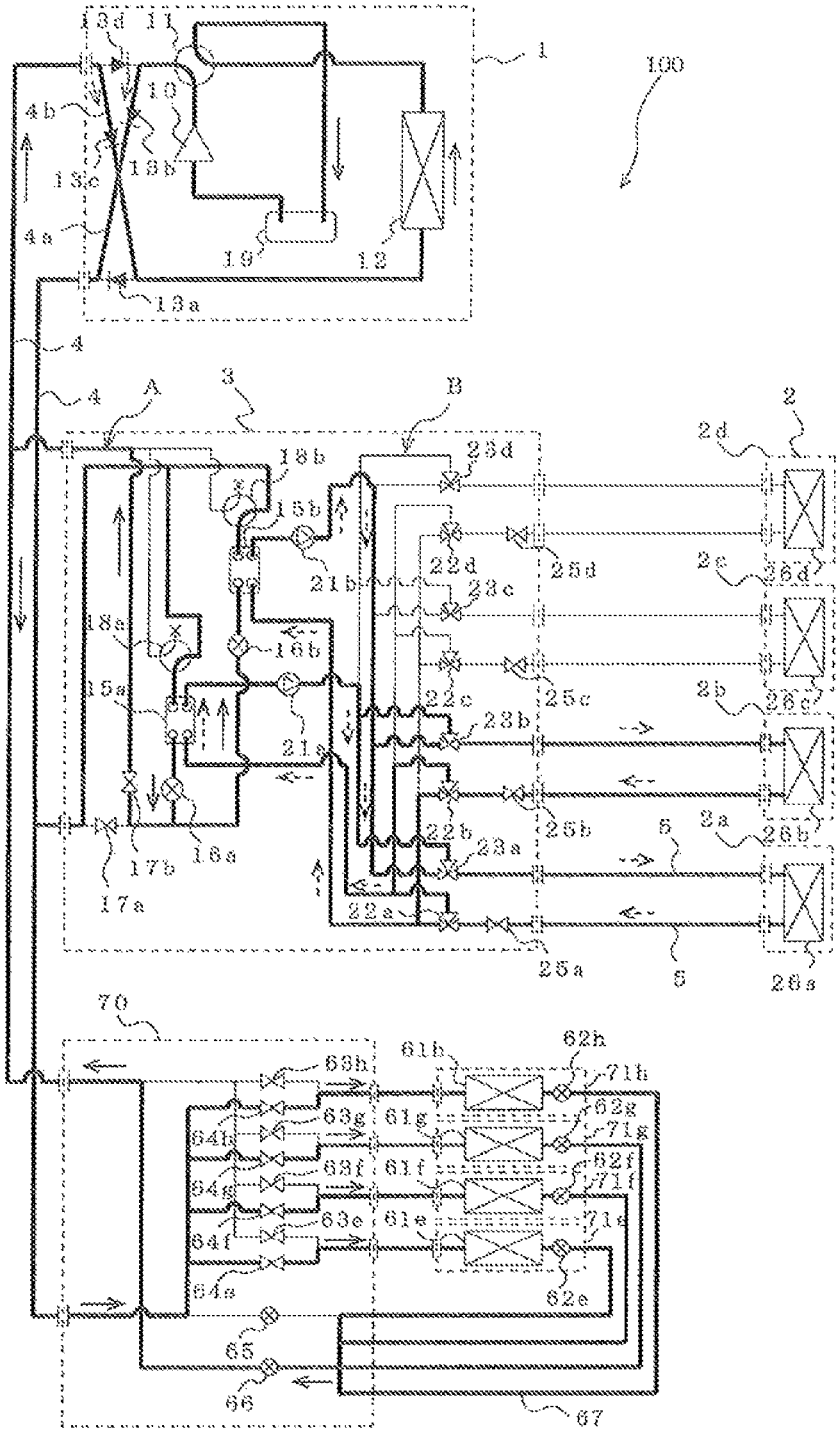
FIG. 4 is a refrigerant circuit diagram showing the flow of the refrigerant during a heating only operation mode of the air-conditioning apparatus shown in FIG. 2.

FIG. 4 is a refrigerant circuit diagram showing the flow of the refrigerant during the heating only operation mode of the air-conditioning apparatus 100 shown in FIG. 2. In FIG. 4, the heating only operation mode will be described with, as an example, the case where heating energy loads are generated at the use side heat exchangers 26*a*, 26*b*, and 61*e* to 61*h*. In FIG. 4, the pipes represented by thick lines indicate pipes through which the refrigerants (the heat source side refrigerant and the heat medium) flow. In addition, in FIG. 4, the flow direction of the heat source side refrigerant is indicated by solid arrows, and the flow direction of the heat medium is indicated by dashed arrows.

In the case of the heating only operation mode shown in FIG. 4, in the outdoor unit 1, the first refrigerant flow switching device 11 is switched such that the heat source side refrigerant having discharged from the compressor 10 flows into the heat medium relay unit 3 without passing through the heat source side heat exchanger 12. In the heat medium relay unit 3, the pump 21*a* and the pump 21*b* are actuated, the heat medium flow control device 25*a* and the heat medium flow control device 25*b* are opened, and the heat medium flow control device 25*c* and the heat medium flow control device 25*d* are fully closed, whereby the heat medium circulates between each of the intermediate heat exchanger 15*a* and the intermediate heat exchanger 15*b* and the use side heat exchanger 26*a* and the use side heat exchanger 26*b*.

First, flow of the heat source side refrigerant in the refrigerant circulation circuit A will be described. The low-temperature and low-pressure refrigerant is compressed by the compressor 10 into a high-temperature and high-pressure gas refrigerant, and is discharged therefrom. The high-temperature and high-pressure gas refrigerant having discharged from the compressor 10 passes through the first refrigerant flow switching device 11 and the check valve 13*b* and flows out of the outdoor unit 1. The high-temperature and high-pressure gas refrigerant having flowed out of the outdoor unit 1 flows through the refrigerant pipe 4 into the heat medium relay unit 3. The high-temperature and high-pressure gas refrigerant having flowed into the heat medium relay unit 3 is branched, passes through the second refrigerant flow switching device 18*a* and the second refrigerant flow switching device 18*b*, and flows into the intermediate heat exchanger 15*a* and the intermediate heat exchanger 15*b*.

The high-temperature and high-pressure gas refrigerant having flowed into the intermediate heat exchanger 15*a* and the intermediate heat exchanger 15*b* becomes a high-pressure liquid refrigerant while rejecting heat to the heat medium circulating through the heat medium circulation circuit B. The liquid refrigerant having flowed out of the intermediate heat exchanger 15*a* and the intermediate heat exchanger 15*b* is expanded at the expansion device 16*a* and the expansion device 16*b* into a low-temperature and low-pressure two-phase refrigerant. The two-phase refrigerant flows out of the heat medium relay unit 3 through the opening/closing device 17*b* and flows through the refrigerant pipe 4 into the outdoor unit 1 again. It should be noted that the opening/closing device 17*a* is closed.

The refrigerant having flowed into the outdoor unit 1 flows through the check valve 13*c* into the heat source side heat exchanger 12 which acts as an evaporator. Then, the refrigerant having flowed into the heat source side heat exchanger 12 removes heat from the outside air and becomes a low-temperature and low-pressure gas refrigerant at the heat source side heat exchanger 12. The low-temperature and low-pressure gas refrigerant having flowed out of the heat source side heat exchanger 12 is sucked into the compressor 10 again through the first refrigerant flow switching device 11 and the accumulator 19.

Next, flow of the heat medium in the heat medium circulation circuit B will be described.

In the heating only operation mode, heating energy of the heat source side refrigerant is transmitted to the heat medium at both the intermediate heat exchanger 15*a* and the intermediate heat exchanger 15*b*, and the heated heat medium is moved in the pipes 5 by the pump 21*a* and the pump 21*b*. The heat medium having compressed by the pump 21*a* and the pump 21*b* and having flowed out flows through the second heat medium flow switching device 23*a* and the second heat medium flow switching device 23*b* into the use side heat exchanger 26*a* and the use side heat exchanger 26*b*. Then, the heat medium rejects heat to the indoor air at the use side heat exchanger 26*a* and the use side heat exchanger 26*b*, thereby heating the indoor space 7.

Then, the heat medium flows out of the use side heat exchanger 26*a* and the use side heat exchanger 26*b* and flows into the heat medium flow control device 25*a* and the heat medium flow control device 25*b*. At that time, the flow rate of the heat medium is controlled by the action of the heat medium flow control device 25*a* and the heat medium flow control device 25*b* to a flow rate required for an air conditioning load required in the indoor, and the heat medium flows into the use side heat exchanger 26*a* and the use side heat exchanger 26*b*. The heat medium having flowed out of the heat medium flow control device 25*a* and the heat medium flow control device 25*b* flows through the first heat medium flow switching device 22*a* and the first heat medium flow switching device 22*b* into the intermediate heat exchanger 15*a* and the intermediate heat exchanger 15*b* and is sucked into the pump 21*a* and the pump 21*b* again.

In executing the heating only operation mode, since there is no need to flow the heat medium to the use side heat exchanger 26 in which there is no thermal load (including thermo-off), the flow path is closed by the heat medium flow control device 25 such that the heat medium does not flow to the use side heat exchanger 26. In FIG. 4, the heat medium is flowing through the use side heat exchanger 26*a* and the use side heat exchanger 26*b* since there are thermal loads in the use side heat exchanger 26*a* and the use side heat exchanger 26*b*, but there are no thermal loads in the use side heat exchanger 26*c* and the use side heat exchanger 26*d*, and the corresponding heat medium flow control device 25*c* and the corresponding heat medium flow control device 25*d* are fully closed. Then, when thermal loads are generated from the use side heat exchanger 26*c* and the use side heat exchanger 26*d*, the heat medium flow control device 25*c* and the heat medium flow control device 25*d* may be opened to circulate the heat medium therethrough.

In addition, the heat source side refrigerant (gas refrigerant) having passed through the above pipe 4 also flows to the relay unit 70 side, passes through the solenoid valve 64, rejects heat at the use side heat exchangers 61, passes through the indoor expansion devices 62 and the expansion device 66, and then returns through the pipe 4 to the outdoor unit 1. Thus, the indoor space 80 is heated.

[Cooling Main Operation Mode]

Figure 5:
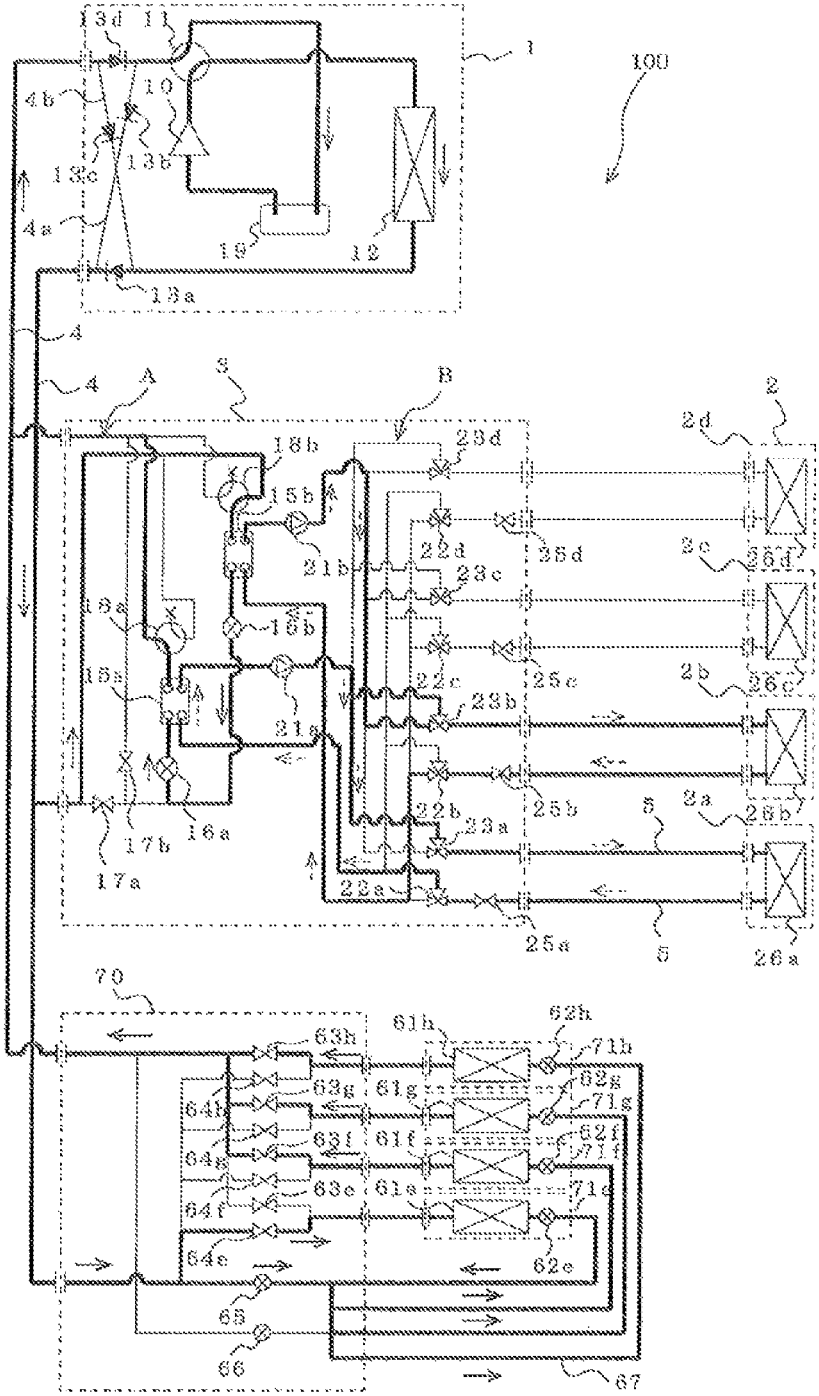
FIG. 5 is a refrigerant circuit diagram showing the flow of the refrigerant during a cooling main operation mode of the air-conditioning apparatus shown in FIG. 2.

FIG. 5 is a refrigerant circuit diagram showing the flow of the refrigerant during the cooling main operation mode of the air-conditioning apparatus 100 shown in FIG. 2. In FIG. 5, the cooling main operation mode will be described with, as an example, the case where a cooling energy load is generated at the use side heat exchanger 26*a* and a heating energy load is generated at the use side heat exchanger 26*b*. In FIG. 5, the pipes represented by thick lines indicate pipes through which the refrigerants (the heat source side refrigerant and the heat medium) circulate. In addition, in FIG. 5, the flow direction of the heat source side refrigerant is indicated by solid arrows, and the flow direction of the heat medium is indicated by dashed arrows.

In the case of the cooling main operation mode shown in FIG. 5, in the outdoor unit 1, the first refrigerant flow switching device 11 is switched such that the heat source side refrigerant having discharged from the compressor 10 flows into the heat source side heat exchanger 12. In the heat medium relay unit 3, the pump 21*a* and the pump 21*b* are activated, the heat medium flow control device 25*a* and the heat medium flow control device 25*b* are opened, and the heat medium flow control device 25*c* and the heat medium flow control device 25*d* are fully closed, whereby the heat medium circulates between the intermediate heat exchanger 15*a* and the use side heat exchanger 26*a* and between the intermediate heat exchanger 15*b* and the use side heat exchanger 26*b*.

First, flow of the heat source side refrigerant in the refrigerant circulation circuit A will be described. The low-temperature and low-pressure refrigerant is compressed by the compressor 10 into a high-temperature and high-pressure gas refrigerant, and is discharged therefrom. The high-temperature and high-pressure gas refrigerant having discharged from the compressor 10 flows through the first refrigerant flow switching device 11 into the heat source side heat exchanger 12. Then, the gas refrigerant becomes a liquid refrigerant while rejecting heat to the outside air at the heat source side heat exchanger 12. The refrigerant having flowed out of the heat source side heat exchanger 12 flows out of the outdoor unit 1 and flows through the check valve 13*a* and the refrigerant pipe 4 into the heat medium relay unit 3. The refrigerant having flowed into the heat medium relay unit 3 flows through the second refrigerant flow switching device 18*b* into the intermediate heat exchanger 15*b* which acts as a condenser.

The refrigerant having flowed into the intermediate heat exchanger 15*b* becomes a refrigerant having a further decreased temperature, while rejecting heat to the heat medium circulating through the heat medium circulation circuit B. The refrigerant having flowed out of the intermediate heat exchanger 15*b* is expanded at the expansion device 16*b* into a low-pressure two-phase refrigerant. The low-pressure two-phase refrigerant flows through the expansion device 16*a* into the intermediate heat exchanger 15*a* which acts as an evaporator. The low-pressure two-phase refrigerant having flowed into the intermediate heat exchanger 15*a* becomes a low-pressure gas refrigerant while cooling the heat medium by removing heat from the heat medium circulating the heat medium circulation circuit B. The gas refrigerant flows out of the intermediate heat exchanger 15*a*, flows out of the heat medium relay unit 3 through the second refrigerant flow switching device 18*a*, and flows through the refrigerant pipe 4 into the outdoor unit 1 again. The refrigerant having flowed into the outdoor unit 1 is sucked into the compressor 10 again through the check valve 13*d*, the first refrigerant flow switching device 11, and the accumulator 19.

Next, flow of the heat medium in the heat medium circulation circuit B will be described.

In the cooling main operation mode, heating energy of the heat source side refrigerant is transmitted to the heat medium at the intermediate heat exchanger 15*b*, and the heated heat medium is moved in the pipe 5 by the pump 21*b*. In addition, in the cooling main operation mode, cooling energy of the heat source side refrigerant is transmitted to the heat medium at the intermediate heat exchanger 15*a*, and the cooled heat medium is moved in the pipe 5 by the pump 21*a*. The heated heat medium having compressed by the pump 21*b* and having flowed out flows through the second heat medium flow switching device 23*b* into the use side heat exchanger 26*b*. The cooled heat medium having compressed by the pump 21*a* and having flowed out flows through the second heat medium flow switching device 23*a* into the use side heat exchanger 26*a*.

At the use side heat exchanger 26*b*, the heat medium rejects heat to the indoor air, thereby heating the indoor space 7. In addition, at the use side heat exchanger 26*a*, the heat medium removes heat from the indoor air, thereby cooling the indoor space 7. At that time, the flow rate of the heat medium is controlled by the action of the heat medium flow control device 25*a* and the heat medium flow control device 25*b* to a flow rate required for an air conditioning load required in the indoor, and the heat medium flows into the use side heat exchanger 26*a* and the use side heat exchanger 26*b*. The heat medium having passed through the use side heat exchanger 26*b* and having a slightly decreased temperature flows through the heat medium flow control device 25*b* and the first heat medium flow switching device 22*b* into the intermediate heat exchanger 15*b* and is sucked into the pump 21*b* again. On the other hand, the heat medium having passed through the use side heat exchanger 26*a* and having a slightly increased temperature flows through the heat medium flow control device 25*a* and the first heat medium flow switching device 22*a* into the intermediate heat exchanger 15*a* and is sucked into the pump 21*a* again.

In executing the cooling main operation mode, since there is no need to flow the heat medium to the use side heat exchanger 26 in which there is no thermal load (including thermo-off), the flow path is closed by the heat medium flow control device 25 such that the heat medium does not flow to the use side heat exchanger 26. In FIG. 5, the heat medium is flowing through the use side heat exchanger 26*a* and the use side heat exchanger 26*b* since there are thermal loads in the use side heat exchanger 26*a* and the use side heat exchanger 26*b*, but there are no thermal loads in the use side heat exchanger 26*c* and the use side heat exchanger 26*d*, and the corresponding heat medium flow control device 25*c* and the corresponding heat medium flow control device 25*d* are fully closed. Then, when thermal loads are generated from the use side heat exchanger 26*c* and the use side heat exchanger 26*d*, the heat medium flow control device 25*c* and the heat medium flow control device 25*d* may be opened to circulate the heat medium therethrough.

In addition, the refrigerant having passed through the above pipe 4 also flows to the relay unit 70 side, and a portion of the refrigerant having flowed therein enters the indoor unit 71*e* through the solenoid valve 64*e*, rejects heat at the use side heat exchanger 61*e*, then is reduced in pressure at the expansion device 62*e*, and flows into the relay unit 70 again. The refrigerant having flowed therein again joins the refrigerant having passed through the expansion device 65, flows through the indoor expansion devices 62*f* to 62*h*, then removes heat and evaporates at the use side heat exchangers 61*f* to 61*h*, flows through the solenoid valve 63, and returns to the outdoor unit 1.

[Heating Main Operation Mode]

Figure 6:
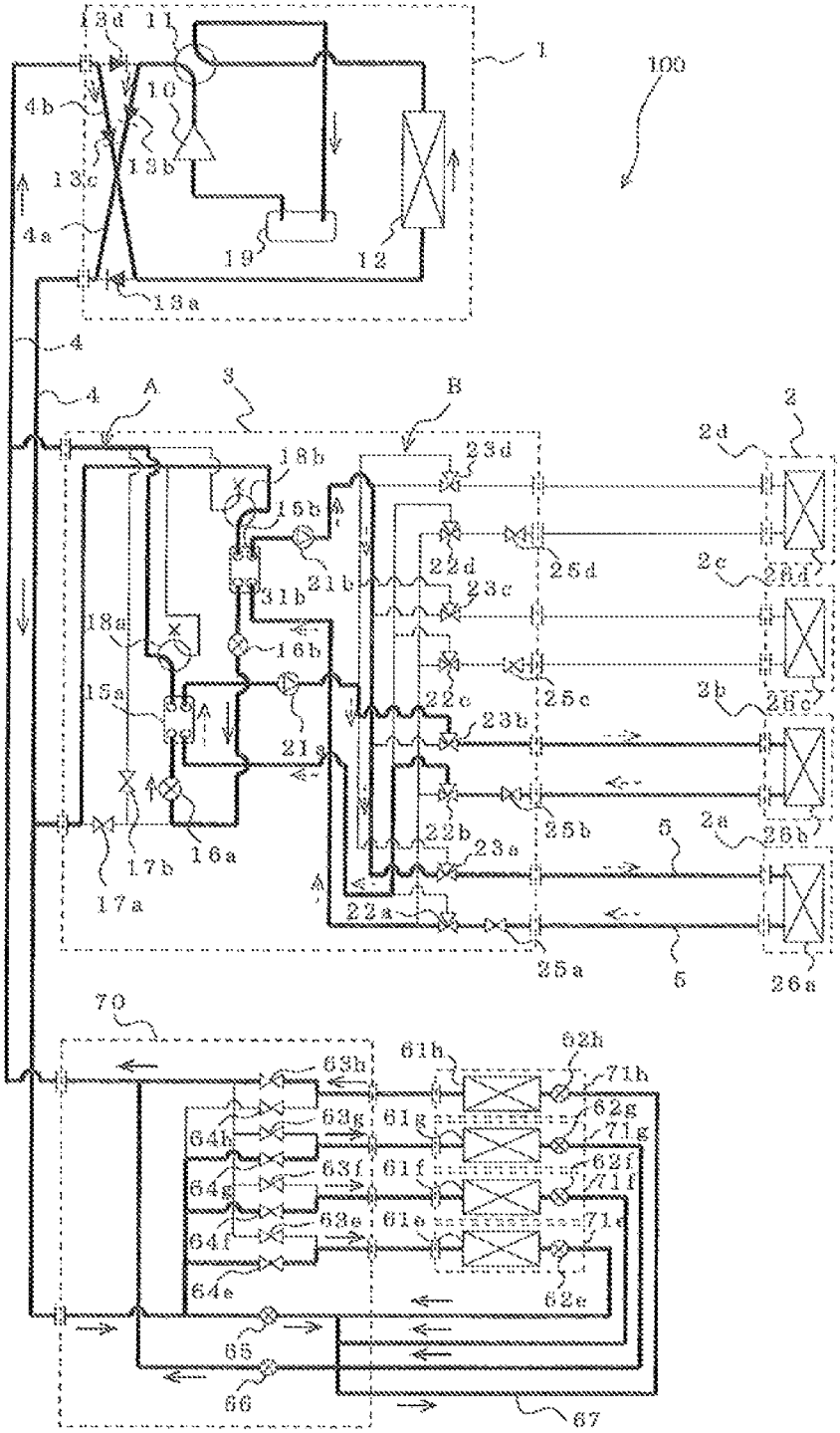
FIG. 6 is a refrigerant circuit diagram showing the flow of the refrigerant during a heating main operation mode of the air-conditioning apparatus shown in FIG. 2.

FIG. 6 is a refrigerant circuit diagram showing the flow of the refrigerant during the heating main operation mode of the air-conditioning apparatus 100 shown in FIG. 2. In FIG. 6, the heating main operation mode will be described with, as an example, the case where a heating energy load is generated at the use side heat exchanger 26*a* and a cooling energy load is generated at the use side heat exchanger 26*b*. In FIG. 6, the pipes represented by thick lines indicate pipes through which the refrigerants (the heat source side refrigerant and the heat medium) circulate. In addition, in FIG. 6, the flow direction of the heat source side refrigerant is indicated by solid arrows, and the flow direction of the heat medium is indicated by dashed arrows.

In the case of the heating main operation mode shown in FIG. 6, in the outdoor unit 1, the first refrigerant flow switching device 11 is switched such that the heat source side refrigerant having discharged from the compressor 10 flows into the heat medium relay unit 3 without passing through the heat source side heat exchanger 12. In the heat medium relay unit 3, the pump 21*a* and the pump 21*b* are activated, the heat medium flow control device 25*a* and the heat medium flow control device 25*b* are opened, and the heat medium flow control device 25*c* and the heat medium flow control device 25*d* are fully closed, whereby the heat medium circulates between the intermediate heat exchanger 15*a* and the use side heat exchanger 26*b* and between the intermediate heat exchanger 15*b* and the use side heat exchanger 26*a*.

First, flow of the heat source side refrigerant in the refrigerant circulation circuit A will be described. The low-temperature and low-pressure refrigerant is compressed by the compressor 10 into a high-temperature and high-pressure gas refrigerant, and is discharged therefrom. The high-temperature and high-pressure gas refrigerant having discharged from the compressor 10 passes through the first refrigerant flow switching device 11 and the check valve 13*b* and flows out of the outdoor unit 1. The high-temperature and high-pressure gas refrigerant having flowed from the outdoor unit 1 flows through the refrigerant pipe 4 into the heat medium relay unit 3. The high-temperature and high-pressure gas refrigerant having flowed into the heat medium relay unit 3 flows through the second refrigerant flow switching device 18*b* into the intermediate heat exchanger 15*b* which acts as a condenser.

The gas refrigerant having flowed into the intermediate heat exchanger 15*b* becomes a liquid refrigerant while rejecting heat to the heat medium circulating through the heat medium circulation circuit B. The refrigerant having flowed out of the intermediate heat exchanger 15*b* is expanded at the expansion device 16*b* into a low-pressure two-phase refrigerant. The low-pressure two-phase refrigerant flows through the expansion device 16*a* into the intermediate heat exchanger 15*a* which acts as an evaporator. The low-pressure two-phase refrigerant having flowed into the intermediate heat exchanger 15*a* evaporates by removing heat from the heat medium circulating through the heat medium circulation circuit B, thereby cooling the heat medium. The low-pressure two-phase refrigerant flows out of the intermediate heat exchanger 15*a* and flows out of the heat medium relay unit 3 through the second refrigerant flow switching device 18*a*, and flows into the outdoor unit 1 again.

The refrigerant having flowed into the outdoor unit 1 flows through the check valve 13*c* into the heat source side heat exchanger 12 which acts as an evaporator. Then, the refrigerant having flowed into the heat source side heat exchanger 12 removes heat from the outside air and becomes a low-temperature and low-pressure gas refrigerant at the heat source side heat exchanger 12. The low-temperature and low-pressure gas refrigerant having flowed out of the heat source side heat exchanger 12 is sucked into the compressor 10 again through the first refrigerant flow switching device 11 and the accumulator 19.

Next, flow of the heat medium in the heat medium circulation circuit B will be described.

In the heating main operation mode, heating energy of the heat source side refrigerant is transmitted to the heat medium at the intermediate heat exchanger 15*b*, and the heated heat medium is moved in the pipe 5 by the pump 21*b*. In addition, in the heating main operation mode, cooling energy of the heat source side refrigerant is transmitted to the heat medium at the intermediate heat exchanger 15*a*, and the cooled heat medium is moved in the pipe 5 by the pump 21*a*. The heated heat medium having compressed by the pump 21*b* and having flowed out flows through the second heat medium flow switching device 23*a* into the use side heat exchanger 26*a*. The cooled heat medium having compressed by the pump 21*a* and having flowed out flows through the second heat medium flow switching device 23*b* into the use side heat exchanger 26*b*.

At the use side heat exchanger 26*b*, the heat medium removes heat from the indoor air, thereby cooling the indoor space 7. In addition, at the use side heat exchanger 26*a*, the heat medium rejects heat to the indoor air, thereby heating the indoor space 7. At that time, the flow rate of the heat medium is controlled by the action of the heat medium flow control device 25*a* and the heat medium flow control device 25*b* to a flow rate required for an air conditioning load required in the indoor, and the heat medium flows into the use side heat exchanger 26*a* and the use side heat exchanger 26*b*. The heat medium having passed through the use side heat exchanger 26*b* and having a slightly increased temperature flows through the heat medium flow control device 25*b* and the first heat medium flow switching device 22*b* into the intermediate heat exchanger 15*a* and is sucked into the pump 21*a* again. The heat medium having pass through the use side heat exchanger 26*a* and having a slightly decreased temperature flows through the heat medium flow control device 25*a* and the first heat medium flow switching device 22*a* into the intermediate heat exchanger 15*b* and is sucked into the pump 21*b* again.

In executing the heating main operation mode, since there is no need to flow the heat medium to the use side heat exchanger 26 in which there is no thermal load (including thermo-off), the flow path is closed by the heat medium flow control device 25 such that the heat medium does not flow to the use side heat exchanger 26. In FIG. 6, the heat medium is flowing through the use side heat exchanger 26*a* and the use side heat exchanger 26*b* since there are thermal loads in the use side heat exchanger 26*a* and the use side heat exchanger 26*b*, but there are no thermal loads in the use side heat exchanger 26*c* and the use side heat exchanger 26*d*, and the corresponding heat medium flow control device 25*c* and the corresponding heat medium flow control device 25*d* are fully closed. Then, when thermal loads are generated from the use side heat exchanger 26*c* and the use side heat exchanger 26*d*, the heat medium flow control device 25*c* and the heat medium flow control device 25*d* may be opened to circulate the heat medium therethrough.

In addition, the gas refrigerant having passed through the above pipe 4 also flows into the relay unit 70 side, and a portion of the refrigerant having flowed therein enters the solenoid valves 64*e* to 64*g*. The refrigerant having passed through the solenoid valves 64*e* to 64 enters the indoor units 71*e* to 71*g*, rejects heat at the use side heat exchangers 61*e* to 61*g*, then is reduced in pressure at the expansion devices 62*e* to 62*g*, flows into the relay unit 70 again, and joins the refrigerant having passed through the expansion device 65. A portion of the joined refrigerant passes through the expansion device 62*h*, rejects heat and then evaporates at the use side heat exchanger 61*h*, and enters the solenoid valve 63*h*. Then, the refrigerant having flowed out of the solenoid valve 63*h* joins again the refrigerant having separated after the above joining and having passed through the expansion device 66, and returns to the outdoor unit 1.

[Refrigerant Pipe 4]

As described above, the air-conditioning apparatus 100 according to the embodiment includes several operation modes. In these operation modes, the heat source side refrigerant flows through the refrigerant pipes 4 connecting the outdoor unit 1 to the heat medium relay unit 3 or the relay unit 70.

[Pipe 5]

In each of the operation modes executed by the air-conditioning apparatus 100 according to the embodiment, the heat medium such as water or an antifreezing solution flows through the pipes 5 connecting the heat medium relay unit 3 to the indoor units 2.

[Heat Medium]

For example, a brine (antifreezing solution), water, a mixed solution of a brine and water, a mixed solution of water and an additive exhibiting a high anti-corrosion effect, or the like may be used as the heat medium. Therefore, even when the heat medium leaks through the indoor unit 2 to the indoor space 7, the air-conditioning apparatus 100 contributes to improvement of safety since a highly safe medium is used as the heat medium in the air-conditioning apparatus 100.

Next, a method for selecting a medium for heating or cooling which circulates through each indoor unit in installing the indoor unit for the air-conditioning apparatus 100 will be described.

Figure 7:
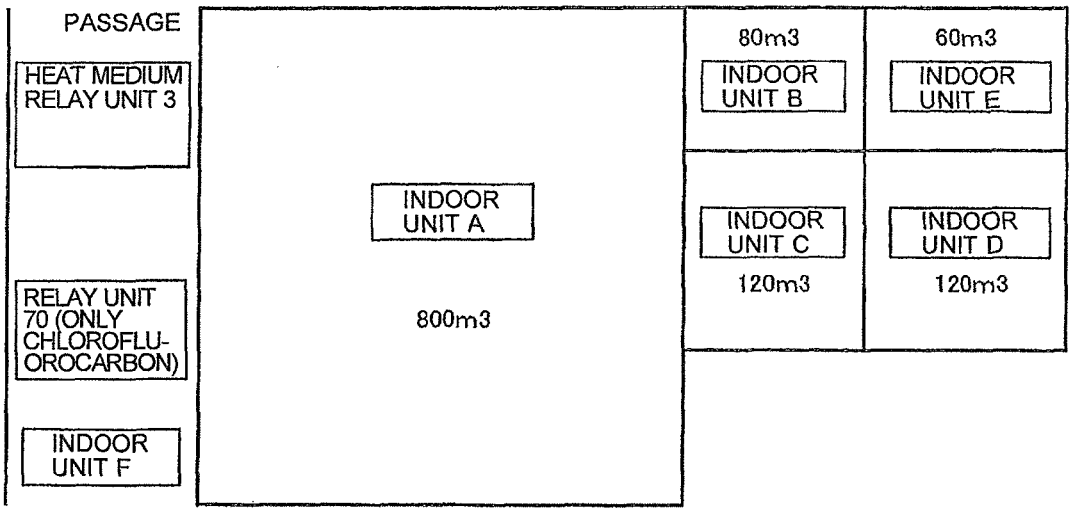
FIG. 7 shows an indoor unit arrangement in indoor spaces according to the embodiment.

FIG. 7 is an example of a space which is air-conditioned by the air-conditioning apparatus 100 including indoor units A to F. The heat medium relay unit 3, the relay unit 70, and the indoor unit F are installed in a space such as a path, and the five indoor units A to E are set to air-condition five air-conditioned spaces (or rooms). Here, the volume of the space for the indoor unit A is 800 $m^3$; the volume of the space for the indoor unit B is 80 $m^3$; the volume of the space for the indoor unit C is 120 $m^3$; the volume of the space for the indoor unit D is 120 $m^3$; and the volume of the space for the indoor unit E is 60 $m^3$. The distance from the relay unit 70 to each indoor unit is shorter in order of the indoor units A, B, C, D, and E. It should be noted that the signs for the indoor units A to E are signs defined separately from the signs for the indoor units 2 and 71 shown in FIGS. 1 to 6.

Figure 8:
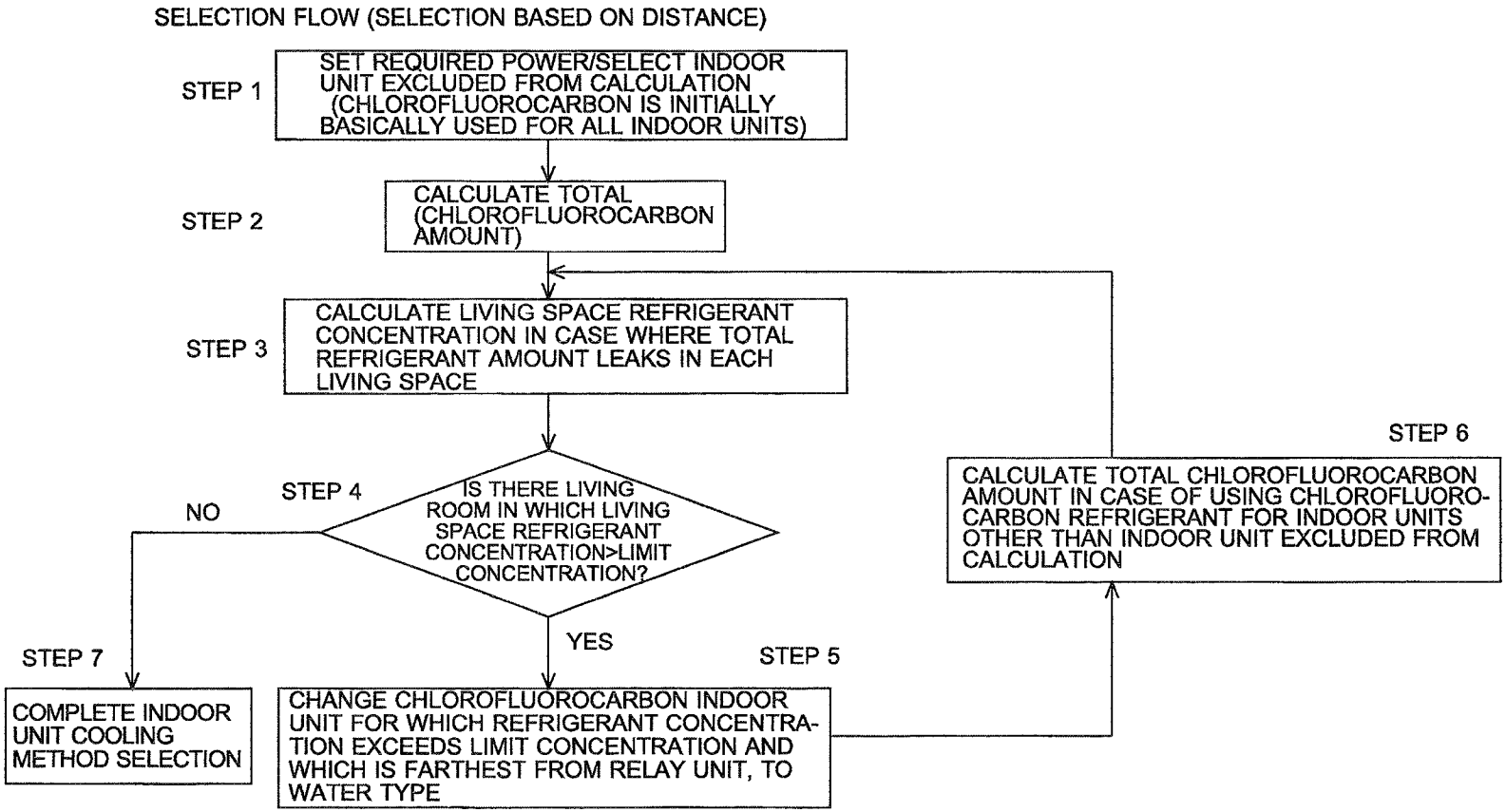
FIG. 8 is a flowchart explaining a cooling medium selection flow (selection based on distance) used in the air-conditioning apparatus according to the embodiment.

FIG. 8 is a flowchart showing a method for selecting, based on distance, the medium which circulates through the indoor unit disposed in each space in FIG. 7 according to one embodiment of the present invention.

(Step 1)

Power required for each of the spaces in which the respective indoor units A to E is selected. In addition, at that time, an indoor unit excluded from automatic selection is selected. For example, in the case of installation at a shared floor like the indoor unit F, water is not used and a refrigerant is used as a medium. It should be noted that if refrigerant sound is noisy, water may be selected as a medium. It should be noted that in FIG. 8, for convenience, a chlorofluorocarbon refrigerant is used as a refrigerant.

(Step 2)

The total refrigerant amount in the air-conditioning apparatus 100 when each of the media of the indoor units (here, A to E) other than the indoor unit excluded in step 1 is the refrigerant is calculated. For example, here, the total refrigerant amount is 25 kg.

(Step 3)

A concentration of the refrigerant when the total refrigerant amount in the air-conditioning apparatus 100 leaks to one air-conditioned space is calculated for each air-conditioned space. For example, for the space for the indoor unit B, 25 kg÷80 $m^3$=0.31 kg/$m^3$; and for the space for the indoor unit E, 25 kg÷60 $m^3$=0.416 kg/$m^3$.

(Step 4)

It is determined whether as a result of the calculation in step 3, there is an air-conditioned space for which the refrigerant concentration exceeds a limit concentration. For example, when the limit concentration is set at 0.3 kg/$m^3$, the air-conditioned spaces for the indoor unit B (0.31 kg/$m^3$) and the indoor unit E (0.416 kg/$m^3$) exceed the limit concentration.

(Step 5)

Of the air-conditioned spaces exceeding the limit concentration in step 4, the medium of the use side heat exchanger of the indoor unit 71 farthest from the relay unit 70 is changed from the refrigerant to water. In this example, regarding the above distance, the indoor unit E is farther than the indoor unit B, and thus water is used as the medium for the indoor unit E. It should be noted that the above "indoor unit 71 farthest from the relay unit 70" corresponds to the fact that the refrigerant circuit length from the relay unit 70 to the indoor unit 71 is longest. For this, it is considered that the longer the refrigerant circuit from the relay unit 70 to the indoor unit 71 is, the more the leak amount of the refrigerant is.

(Step 6)

The total refrigerant amount in the air-conditioning apparatus 100 is calculated again, and the processing returns to step 3.

(Step 7)

When there is no air-conditioned space exceeding the limit concentration in step 4, the consideration is completed and the media of the indoor units are determined.

According to the flow in FIG. 8, it is automatically determined to circulate the refrigerant through the indoor units A to D and to circulate water through the indoor unit E. Therefore, the indoor units 71 shown in FIGS. 1 to 6 are used as the indoor units A to D, and the indoor unit 2 shown in FIGS. 1 to 6 is used as the indoor unit E.

Figure 9:
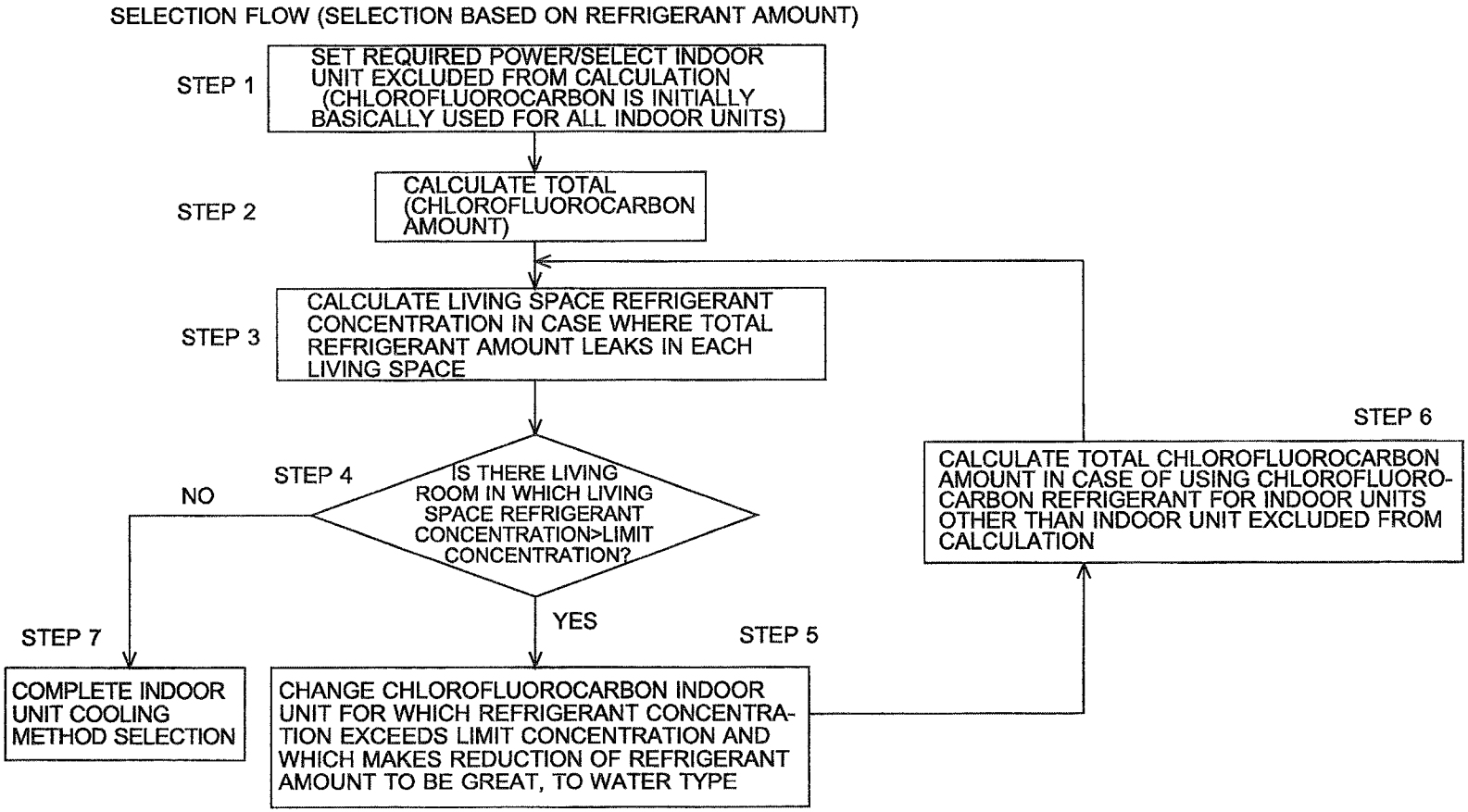
FIG. 9 is a flowchart explaining a cooling medium selection flow (selection based on refrigerant amount) used in the air-conditioning apparatus according to the embodiment.

FIG. 9 is a flowchart showing a method for selecting, based on amount, the medium which circulates through the indoor unit disposed in each space of FIG. 7 according to another embodiment of the present invention. The difference between FIG. 9 and FIG. 8 is only step 5. In other words, in the example of FIG. 9, of the air-conditioned spaces exceeding the limit concentration, the circulation medium corresponding to the indoor unit that makes the total refrigerant amount in the air-conditioning apparatus 100 to be minimum (i.e., the indoor unit that makes the reduction of the total refrigerant amount to be maximum) is changed to water.

Figure 10:
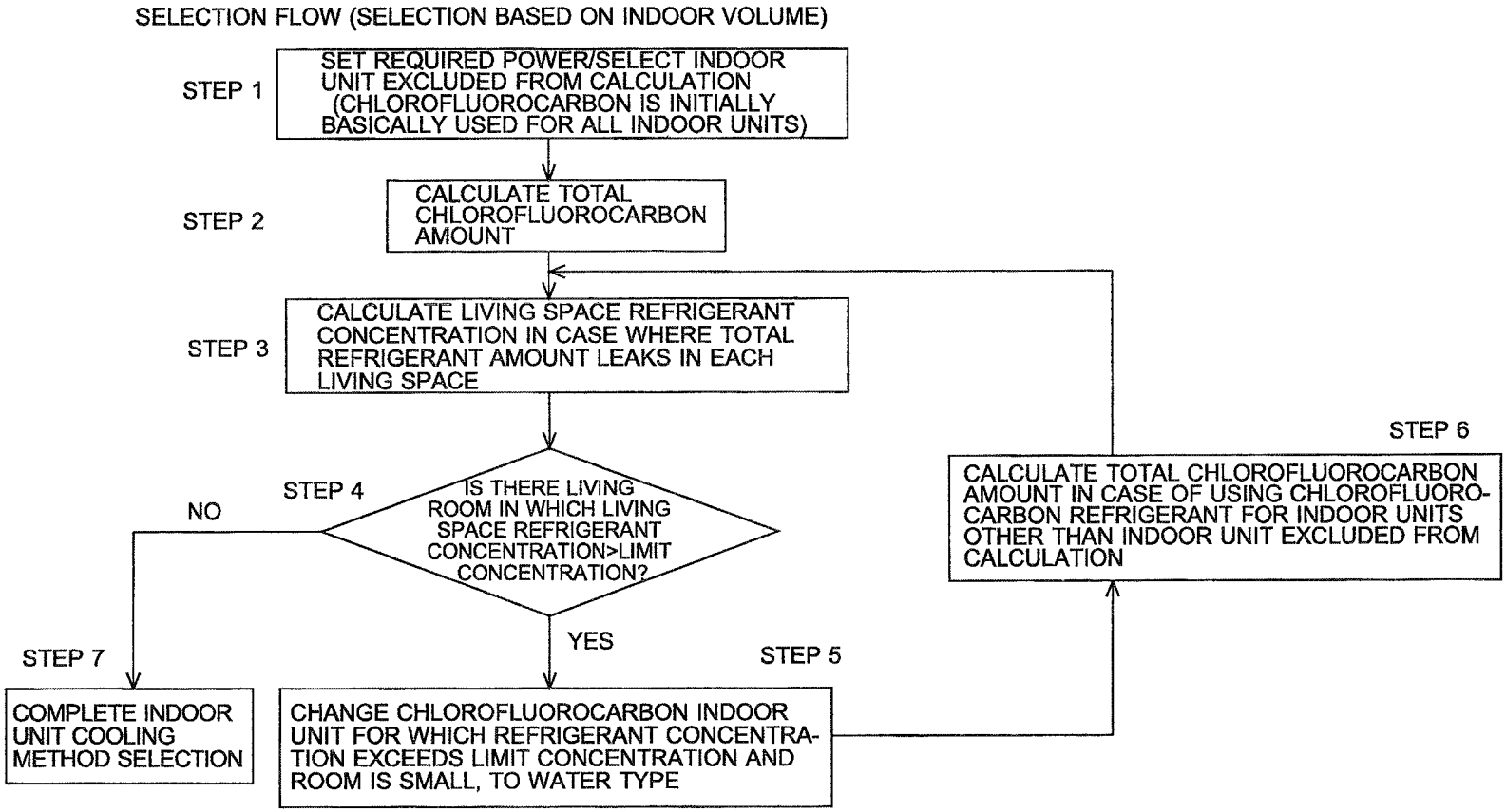
FIG. 10 is a flowchart explaining a cooling medium selection flow (selection based on indoor volume) used in the air-conditioning apparatus according to the embodiment.

FIG. 10 is a flowchart showing a method for selecting, based on indoor volume, the medium which circulates through the indoor unit disposed in each space of FIG. 7 according to another embodiment of the present invention. The difference between FIG. 10 and FIG. 8 is only step 5. In other words, in the example of FIG. 10, of the air-conditioned spaces exceeding the limit concentration, the circulation medium of the indoor unit corresponding to the air-conditioned space having a smallest volume is changed to water.

It should be noted that in step 5, regardless of the limit concentration, the circulation media of "the indoor unit farthest from the relay unit", "the indoor unit that makes the reduction of the total refrigerant amount to be maximum", and "the indoor unit corresponding to the air-conditioned space having a smallest volume" may simply be determined as water.

By using the methods as shown in FIGS. 8 to 10, it is possible to automatically determine how to selectively use a heat medium (refrigerant, water, brine, etc.) circulating through an indoor unit in installing the system, shown in FIGS. 1 to 6, in which air-conditioning with a refrigerant and air-conditioning with water or brine are performed. Thus, an effect is provided that it is possible to prevent leak of the refrigerant exceeding an allowable limit in any of the air-conditioned spaces.

The invention claimed is:

1. A method for selecting a heat medium of each of a plurality of use side heat exchangers in installing an air-conditioning system in which a plurality of spaces are air-conditioning spaces and two types of circulation heat media including a refrigerant and a nontoxic medium are allowed to coexist as the circulation heat media of a use side heat exchanger installed in each of the plurality of spaces, the method comprising:

a first step of determining power required for the use side heat exchanger assuming that the refrigerant is used and corresponding to each air-conditioned space;

a second step of calculating a total refrigerant amount required when the refrigerant is circulated through all the use side heat exchangers having the determined power;

a third step of calculating a refrigerant concentration when the total refrigerant amount leaks to each air-conditioned space using the refrigerant, for each air-conditioned space;

a fourth step of determining whether or not the refrigerant concentration for each air-conditioned space exceeds a predetermined limit concentration;

a fifth step of, when there are any air-conditioned spaces exceeding the limit concentration in the fourth step, selecting the nontoxic medium as the circulation heat medium of a use side heat exchanger installed in one of the air-conditioned spaces; and a sixth step of calculating a total refrigerant amount required when the refrigerant is circulated through all the use side heat exchangers other than the use side heat exchanger in which the nontoxic medium is selected, as the total refrigerant amount in the third step.

2. The method for selecting the heat medium of claim 1, wherein, in the fifth step, the nontoxic medium is used as the circulation heat medium of the use side heat exchanger farthest from a relay unit which switches a flow of the refrigerant to each use side heat exchanger in accordance with operation states of the plurality of use side heat exchangers.

3. The method for selecting the heat medium of claim 1, wherein, in the fifth step, the nontoxic medium is used as the circulation heat medium of the use side heat exchanger that makes a reduction of the total refrigerant amount to be maximum.

4. The method for selecting the heat medium of claim 1, wherein, in the fifth step, the nontoxic medium is used as the circulation heat medium of the use side heat exchanger corresponding to the air-conditioned space having a smallest volume, among the air-conditioned spaces.

5. The method for selecting the heat medium of claim 1, wherein an air-conditioned space for which the nontoxic medium is selected as the circulation heat medium in the fifth step is selected from among the air-conditioned spaces exceeding the limit concentration in the fourth step.

6. The method for selecting the heat medium of claim 1, wherein a mixed operation of a cooling operation and a heating operation is enabled among the plurality of air-conditioned spaces.

7. The method for selecting the heat medium of claim 1, wherein, the use side heat exchangers are installed such that the use side heat exchangers configured in advance such that the nontoxic medium circulates, are used as the use side heat exchangers in which the nontoxic medium is selected as the circulation heat medium.

* * * * *